United States Patent [19]

Troncoso

[11] Patent Number: 5,074,190

[45] Date of Patent: Dec. 24, 1991

[54] MULTIPLE FIRING GUN ASSEMBLY

[76] Inventor: Vincent F. Troncoso, 14090-6100 Rd., Montrose, Colo. 81401

[21] Appl. No.: 569,200

[22] Filed: Aug. 20, 1990

[51] Int. Cl.[5] ..... F41A 19/16

[52] U.S. Cl. ..... 89/136; 42/69.01

[58] Field of Search ..... 42/65, 69.01, 69.02, 42/69.03, 70.07, 104, DIG. 1; 89/132, 136, 139, 27.3

[56] References Cited

U.S. PATENT DOCUMENTS 4,803,910 2/1989 Troncoso ..... 89/27.3

FOREIGN PATENT DOCUMENTS 363042 11/1922 Fed. Rep. of Germany ..... 42/69.01

546597 7/1942 United Kingdom ..... 42/69.01

*Primary Examiner*—Stephen C. Bentley

*Attorney, Agent, or Firm*—Donald E. Nist

[57] ABSTRACT

The multiple firing gun assembly includes a semi-automatic gun having a firing trigger and a frame including a trigger guard to which is connected a multiple firing trigger biasing device. The device includes a biasing spring contacting and biasing the trigger forward into the ready-to-fire resting position. A connector clamps or otherwise secures the spring in place within the trigger guard. Preferably, the biasing force exerted by the spring is changeable. The spring is either directly in front of or directly behind the trigger and bears against it to either pull it forward or push it forward. In one embodiment, the spring is in the form of a long wire, the upper end of which is positioned against the rear end of the trigger and the lower end of which is secured to a rotatable paddle carried by a trigger guard clamp. The paddle allows the biasing force to be varied. In another embodiment, a spring-biased plunger contacts the rear end of the trigger. The device enables one to balance the force needed to pull and fire the trigger with an about equal force biasing the trigger into its resting position. The result is a dynamic balance which promotes more rapid firing of the trigger.

2 Claims, 2 Drawing Sheets

MULTIPLE FIRING GUN ASSEMBLY

PRIOR ART STATEMENT

Applicant conducted a computerized library search concerning prior art relating to the present invention. However, that search uncovered no relevant prior art, nor does applicant know of any relevant prior art. Consequently, applicant believes the present claimed invention is patentable.

BACKGROUND OF THE INVENTION

1. Field of the Invention

The present invention generally relates to weapons and more particularly to an improved multiple firing gun assembly.

2. Prior Art

Various semi-automatic weapons such as rifles, automatic pistols and the like are currently available. With these weapons, each time the trigger is pulled into the firing position one shot occurs. Between shots the trigger must be returned to the resting position before the firing of another shot can be initiated. The speed of firing such weapons is thus limited by the gunner's ability to squeeze the trigger rapidly, fire and release the trigger, allowing it to return to the resting position and then repeating the sequence. An appreciable period of time is needed to return the trigger to the resting position so that such firing is not rapid.

Semi-automatic weapons can be made fully automatic by modifying their firing mechanism. By full automatic is meant that once the trigger is moved into the firing position, the gun continues to fire shot after shot until the trigger is allowed to return to the resting position However, such weapons, except for military and certain law enforcement uses, are generally illegal.

It would be desireable to provide a simple, efficient, inexpensive and durable device to enable a gunner to sequentially fire a semi-automatic weapon at an increased speed, without modifying the gun to the fully automatic mode. For safety's sake and for sporting purposes the gun would be very useful. This would be particularly the case in hunting large, dangerous game such as African big game, grizzly bears, Kodiak bears and the like, where the hunter could be in serious danger from a charging animal if the hunter could not shoot the semi-automatic weapon rapidly and accurately enough.

SUMMARY OF THE INVENTION

The improved multiple firing gun assembly of the present invention satisfies all the foregoing needs. The assembly is substantially as set forth in the Abstract of the Disclosure.

Thus, the assembly includes a semi-automatic gun such as a combat rifle, automatic hand gun, pistol or the like, the gun having a firing trigger and a frame including a trigger guard. A multiple firing trigger biasing device is connected to the trigger guard. Such device includes a biasing means such as a spring or the like which is positioned directly in front of or directly behind the trigger and contacts it to bias the trigger forward into the resting ready-to-fire position. Preferably, not only the position of the spring can be changed but also the biasing force exerted thereby. A clamp releasably holds the spring in place attached to the trigger guard.

In one embodiment, the biasing means comprises an elongated flexible resilient wire, the upper end of which is positioned against the rear end of the trigger and the lower end of which is connected to a rotatable paddle secured to a trigger guard clamp. Rotation of the paddle changes the force exerted by the upper end of the wire against the trigger. The paddle position can be locked in place to provide any desired biasing force.

In another embodiment the spring is disposed in a plunger body, with a plunger urged forward by the spring into contact with the rear of the trigger. The plunger body is held on a blade connected to a trigger guard clamp. In a further embodiment, a coiled spring is connected to the front of the trigger guard and to the trigger so as to pull it forward.

The device is simple, efficient, can be made inexpensively in a variety of form, sizes and shapes and is durable. Further features of the improved assembly of the present invention are set forth in the following detailed description and accompanying drawings.

DRAWINGS

DETAILED DESCRIPTION

Figure 1:
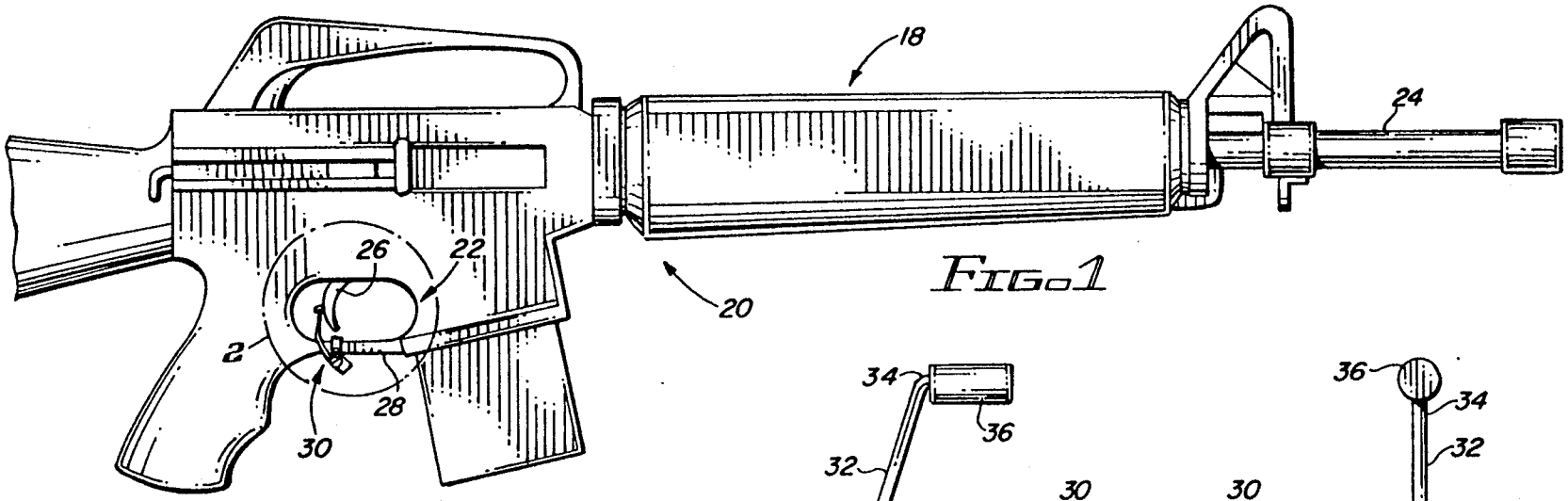
FIG. 1 is a schematic side elevation of a preferred embodiment of the improved multiple firing gun assembly of the present invention.

FIGS. 1–4.

Now referring more particularly to FIGS. 1–4 of the drawings, a first preferred embodiment of the improved multiple firing gun assembly of the present invention is schematically depicted therein. Thus, assembly 18 is shown which includes gun 20, which may be an M-16/AR-15 semiautomatic rifle or the like of standard construction, including a frame 22, barrel 24 and trigger 26 within a trigger guard 28, in modified or unmodified form.

Figure 4:
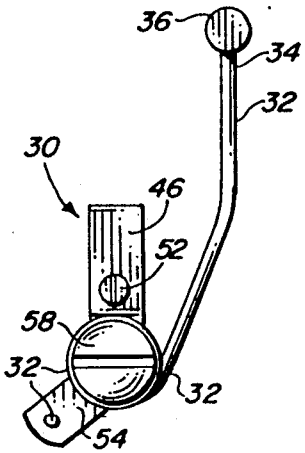
FIG. 4 is an enlarged schematic side elevation of the device of FIG. 2.
Figure 3:
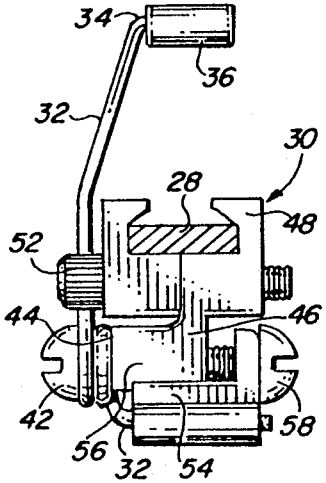
FIG. 3 is an enlarged schematic front elevation of the device of FIG. 2.
Figure 2:
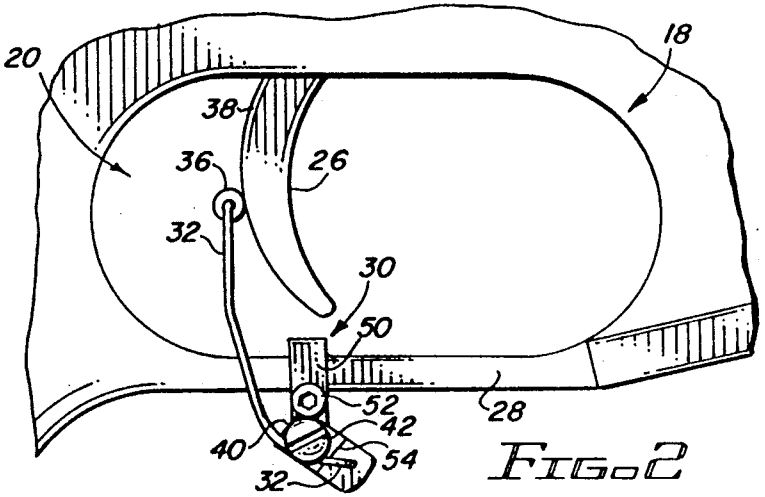
FIG. 2 is an enlarged schematic side elevation of the multiple firing trigger biasing device used in the assembly of FIG. 1.

Assembly 18 further includes a multiple firing trigger-biasing device 30, more easily seen in FIGS. 2, 3 and 4. Device 30 includes an enlongated ,flexible yet relatively stiff wire 32 the upper end 34 of which bears a cross bar 36 and is positioned to abut the rear end 38 of trigger 26. The lower portion 40 of wire 32 is wound around a screw 42 secured to the side 44 of a jaw 46 of a clamp 48. Clamp 48 also includes a second jaw 50 adjustably connected to jaw 46 by a screw 52. Jaws 46 and 50 span trigger guard 28 and releasably lock to it. A paddle 54 is rotatably connected to the lower end 56 of jaw 46 by a screw 58, bears the lower end of wire 32 and is lockable in any desired position by screw 58. Paddle 54 is used to increase or decrease the biasing force exerted by wire 32 on trigger 26, merely by loosening screw 58, rotating paddle appropriately and then tightening screw 58 to lock paddle 54 in place against jaw 46.

Thus, wire 32 can be made to deliver any desired biasing force against trigger 26 to drive it forward. It has been unexpectedly discovered that when that biasing force about equals the trigger pull of trigger 26, an equilibrium is set up which balances the desired forces in opposite directions on trigger 26 and enables trigger 26 to be pulled much more rapidly than normal, for much more rapid firing of gun 20. The balancing of tensions on trigger 26 thus improves the firing characteristics of gun 20. Thus, device 30 is simple, durable, efficient and adjustable. The components thereof can be of any conventional materials, including metal, plastic and the like, as appropriate.

FIG. 5.

Figure 5:
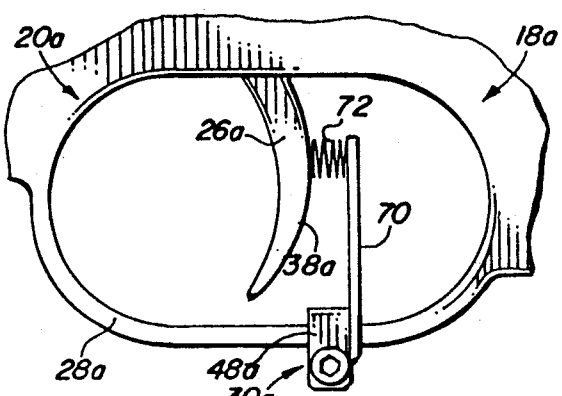
FIG. 5 is an enlarged schematic side elevation of a second preferred embodiment of the multiple firing gun assembly of the present invention.

A second preferred embodiment of the improved multiple firing trigger-biasing assembly of the present invention is schematically depicted in FIG. 5. Thus, device 30*a* is shown connected to the trigger guard 28*a* of a semiautomatic gun 20*a* which may be similar to gun 20 to form assembly 18. Components thereof similar to those of assembly 18 bear the same numerals but are succeeded by the letter "a".

Device 30*a* operates similarly to device 30 and includes a clamp 48*a* to which is connected an upstanding blade 70 bearing a coiled spring 72 at its upper end, which spring 72 presses directly against the rear end 38*a* of trigger 26*a*. Device 30*a* is adjustable only by moving clamp 48*a*.

FIG. 6.

Figure 6:
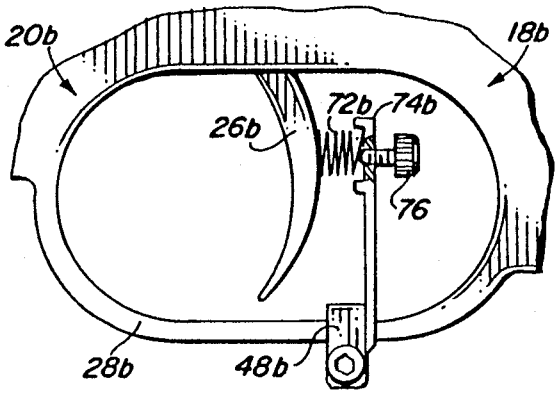
FIG. 6 is an enlarged schematic side elevation of a third preferred embodiment of the multiple firing gun assembly of the present invention.

A third preferred embodiment of the improved assembly of the present invention is schematically depicted in FIG. 6. Thus, assembly 18*b* is shown. Components thereof similar to those of assembly 18 or 18*a* bear the same numerals but are succeeded by the letter "b". Assembly 18*b* differs from assembly 18*a* only as follows:

a) spring 72*b* is a folded flat or leaf spring disposed in an open fronted casing 74;

b) a screw 76 passes through the rear of casing 74 and against spring 72*b* to bias it forward. Thus, the biasing force of spring 72*b* is adjustable. Assembly 18*b* has the advantages of assembly 18.

FIG. 7.

Figure 7:
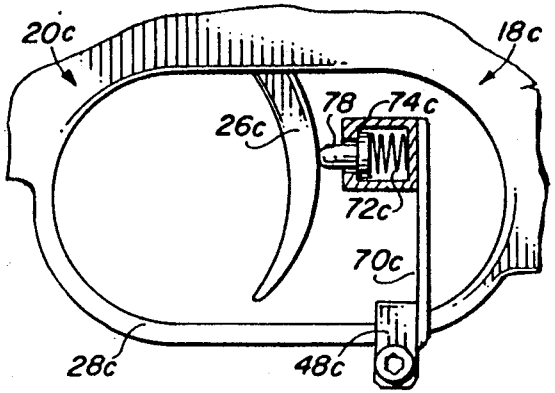
FIG. 7 is an enlarged schematic side elevation, partly in section, of a fourth embodiment of the multiple firing gun assembly of the present invention.

A fourth preferred embodiment of the improved assembly of the present invention is schematically depicted in FIG. 7. Thus, assembly 18*c* is shown. Components thereof similar to those of assembly 18, 18*a* or 18*b* bear the same numerals but are succeeded by the letter "c". Assembly 18*c* is substantially identical to assembly 18*b*, except as follows:

a) casing 74*c* is in the form of a plunger body;

b) a plunger 78 is positioned in body 74*c* ahead of coiled spring 72*c* and is urged thereby into trigger 26*c*;

c) assembly 18*c* is only adjustable by moving clamp 48*c*.

FIG. 8.

Figure 8:
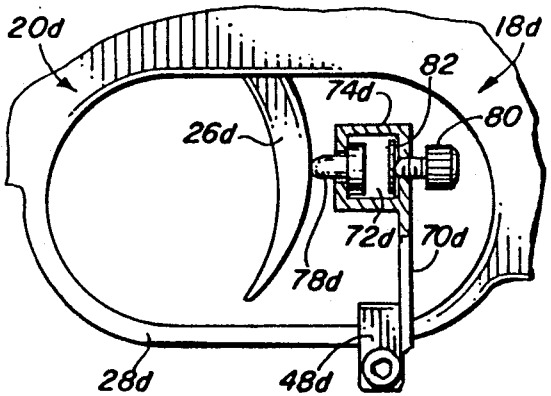
FIG. 8 is an enlarged schematic side elevation, partly in section, of a fifth embodiment of the multiple firing gun assembly of the present invention.

A fifth preferred embodiment of the improved assembly of the present invention is schematically depicted in FIG. 8. Thus, assembly 18*d* is shown. Components thereof similar to those of assembly 18*c* bear the same numerals but are succeeded by the letter "d". Assembly 18*d* is substantially identical to assembly 18*c* except that assembly 18*d* is made adjustable by having a screw 80 with front pusher plate 82 bear against the rear of spring 72*d*.

FIG. 9.

Figure 9:
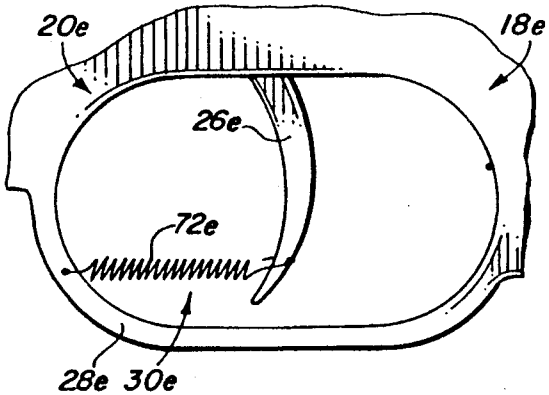
FIG. 9 is an enlarged schematic side elevation of a sixth embodiment of the multiple firing gun assembly of the present invention; and, FIG. 10 is an enlarged schematic side elevation of a seventh embodiment of the multiple firing gun assembly of the present invention.

A sixth preferred embodiment of the improved assembly of the present invention is schematically depicted in FIG. 9. Thus, assembly 18*e* is shown. Components thereof similar to those of assembly 18 bear the same numerals but are succeeded by the letter "e". In place of device 30 which sits behind the trigger and pushes it forward, assembly 18*e* uses device 30*e* which is connected to the front of trigger 26*e* to pull it forward. Thus, coiled spring 72*e* is used, which is connected at its rear end to the front of trigger guard 28*e* and the front of which spring loops around and is attached to trigger 26*e*. Thus, trigger 26*e* is urged forward by spring 72*e*.

FIG. 10.

Figure 10:
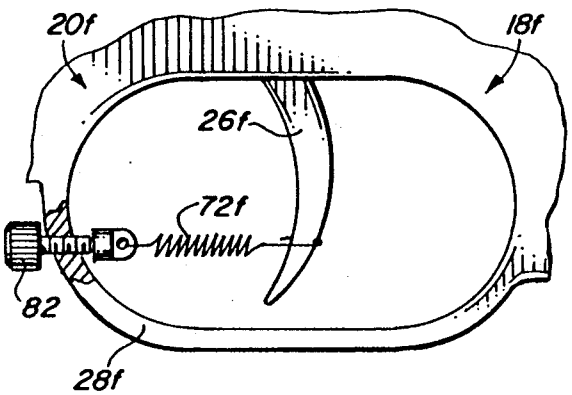

A seventh preferred embodiment of the improved assembly of the present invention is schematically depicted in FIG. 10. Thus, assembly 18*f* is shown. Components thereof similar to those of assembly 18*e* bear the same numerals but are succeeded by the letter "f". Thus, assembly 18*f* is substantially identical to assembly 18*e* except that the biasing force of spring 72*f* is made adjustable. This is accomplished by connecting the rear end of spring 72*f* to a screw 82 threaded through the front of trigger guard 28*f*. When screw is moved back and forth, the tension on spring 72*f* and trigger 26*f* is accordingly changed.

Various other modifications, changes, alterations and additions can be made in the improved multiple firing gun assembly of the present invention, its components and parameters. All such modifications, changes, alterations and additions as are within the scope of the appended claims form part of the present invention.

What is claimed is:

1. An improved multiple firing gun assembly, said gun assembly comprising, in combination:

a) a semi-automatic gun having a firing trigger and a frame including a trigger guard; and, b) a multiple firing trigger biasing device, said device comprising, in combination:

i. biasing means contacting and biasing said trigger forward and into a ready-to-fire position, said biasing means including an elongated flexible resilient wire, the upper end of which abuts the rear of said trigger, the lower end of which is connected to a rotatable paddle carried by an adjustable trigger guard clamp, whereby rotation of said paddle changes the amount of biasing force exerted by said upper end of said wire against said trigger, and, i.i. said adjustable trigger guard clamp being connector means connected to said trigger guard and to said biasing means and adjustably positioning said biasing means within said trigger guard in a position along the line of travel of said trigger either behind or in front of said trigger, whereby rapid firing of said trigger is facilitated.

2. The improved assembly of claim 1 wherein said paddle is lockable into various biasing force positions.

* * * * *